US007665784B2

(12) United States Patent
Stinis

(10) Patent No.: US 7,665,784 B2
(45) Date of Patent: Feb. 23, 2010

(54) CONTAINER GRIPPING DEVICE HAVING CONTACT ELEMENTS FOR BRAKING

(75) Inventor: Cornelis Stinis, Krimpen Aan De Lek (NL)

(73) Assignee: Stinis Beheer B.V., Krimpen Aan de Lek (NL)

( * ) Notice: Subject to any disclaimer, the term of this patent is extended or adjusted under 35 U.S.C. 154(b) by 338 days.

(21) Appl. No.: 10/296,277

(22) PCT Filed: May 28, 2001

(86) PCT No.: PCT/NL01/00410

§ 371 (c)(1),
(2), (4) Date: Jul. 7, 2003

(87) PCT Pub. No.: WO01/89979

PCT Pub. Date: Nov. 29, 2001

(65) Prior Publication Data

US 2004/0100111 A1 May 27, 2004

(30) Foreign Application Priority Data

May 24, 2000 (NL) ..... 1015287

(51) Int. Cl.
*B66C 1/66* (2006.01)

(52) U.S. Cl. ..... 294/81.21; 294/81.53

(58) Field of Classification Search ..... 294/81.53, 294/81.1, 68.1, 68.3, 68.4, 81.21, 81.4, 81.5, 294/81.51, 81.55; 414/607
See application file for complete search history.

(56) References Cited

U.S. PATENT DOCUMENTS 3,558,176 A * 1/1971 Fathauer ..... 294/81.21
3,948,341 A * 4/1976 Foster ..... 180/89.15
4,130,075 A * 12/1978 Larive ..... 114/85
4,139,228 A * 2/1979 Varadi ..... 294/81.53
4,219,228 A * 8/1980 Duckett ..... 294/81.53
4,255,829 A * 3/1981 Tarasiuk ..... 294/64.1
4,358,145 A * 11/1982 Svensson ..... 294/81.53
4,549,841 A * 10/1985 Ishige ..... 294/81.53
4,630,856 A * 12/1986 Peeters Weem et al. .. 294/81.53
5,052,734 A * 10/1991 Hasegawa et al. ..... 294/81.53

(Continued)

FOREIGN PATENT DOCUMENTS

DE 2029681 B 12/1971

(Continued)

*Primary Examiner*—Paul T Chin
(74) *Attorney, Agent, or Firm*—The Webb Law Firm

(57) ABSTRACT

A device for gripping containers from above, which includes a frame which has a number of corners, twist-locks arranged close to each of the corners of the frame for gripping an upper corner of the containers, and contact elements connected to the frame, which elements are biased to a position located at least partly under the frame and which are adapted to brake the movement of the frame in the vicinity of a container when the frame is placed on the container. The presence of these contact elements allows loads on the frame to be reduced and noise nuisance to be minimized. The contact elements, which may be arranged in or on the frame and may protrude through openings formed in the frame, may be elastically deformable or may be pivotally connected to the frame. Compression springs and/or hydraulic cylinders may be arranged between the frame and the contact elements.

27 Claims, 5 Drawing Sheets

U.S. PATENT DOCUMENTS

| | | | | | |
|---|---|---|---|---|---|
| 5,280,980 | A | * | 1/1994 | Coatta | 294/81.1 |
| 5,957,055 | A | * | 9/1999 | Bauer et al. | 104/35 |
| 6,431,379 | B1 | * | 8/2002 | Kroll et al. | 294/81.5 |

FOREIGN PATENT DOCUMENTS

| | | | |
|---|---|---|---|
| EP | 0365086 | * | 10/1989 |
| FR | 2518075 A | | 6/1983 |
| JP | 9-40350 | * | 2/1997 |
| JP | 9-40351 | * | 2/1997 |
| JP | 9-86856 | * | 3/1997 |
| JP | 11-292456 | * | 10/1999 |
| JP | 9-315753 | * | 12/1999 |
| WO | WO 9009336 | | 8/1990 |

* cited by examiner

CONTAINER GRIPPING DEVICE HAVING CONTACT ELEMENTS FOR BRAKING

BACKGROUND OF THE INVENTION

1. Field of the Invention

The invention relates to a device for gripping containers from above.

2. Description of the Related Art

Container gripping devices are generally known and, because the frame is generally adjustable, are usually referred to as spreaders.

Spreaders are applied for gripping containers during hoisting thereof, for instance during loading or unloading of container ships. Standard containers are provided for handling and anchoring thereof with gripping points on the corners, so-called corner castings. These corner castings form reinforced corner points in which an elongate opening is formed. The gripping means of the frame, usually in the form of a so-called twist-lock, can grip in these openings.

A twist-lock consists here of a pin or shank with a hammer head on an outer end, which pin is received at its other outer end in a bush or sleeve, which is connected in turn to a rotating operating mechanism. The twist-lock can be rotated through 90 degrees by the operating mechanism between a position in which the hammer head can be placed in the elongate opening and a position in which the hammer head is fixed in this opening.

Since during loading and unloading of containers the transport means on which or in which the containers are supplied and/or removed necessarily stands or lies still, the time involved herein is in principle costly for the transporter. It is therefore of great importance that this time is minimized by processing the containers as quickly as possible. This entails gripping devices being carried to the containers at increasingly higher speed and hoisting speeds increasing more and more.

Owing to these higher speeds the loads which occur when the frame of the gripping device lands on the container are also becoming increasingly larger. These greater loads result in increased wear and thus a reduction in the life span of the different components of the device, while in addition the high loads result in considerable noise production, both during landing of the frame on the container and at the beginning of the hoisting movement, when the device is not yet fully loaded. This noise results in nuisance, particularly in built-up areas.

It has already been proposed to reduce the loads on the gripping device, and thereby the noise nuisance, by applying spring-mounting and/or damping. There are therefore spreaders on the market wherein each twist-lock with its operating mechanism is accommodated in a housing, which is movable in resilient and/or damped manner in the direction of load relative to the frame, thus parallel to the shank of the twist-lock. In one of the known spreaders rubber blocks arranged between the housing and the frame are used as spring and/or damping elements, while in another known design use is made of hydraulic cylinders.

These known spreaders have the drawback that space is required for guiding of the housing in the frame, whereby the outer dimensions of the frame become larger at the position of the corners, and the frame will therefore protrude outside the container(s). All lateral loads will hereby be absorbed by the frame, so that the chance of damage to the gripping device increases.

The spring and/or damping elements also take up space above the twist-locks, whereby the construction height of the frame increases. This has consequences for the driving of the pivotable centring members or "flippers" usually arranged on the corners of the frame. Because this drive is usually arranged on top of the frame, an increase in the frame height results in a greater distance of the flippers from the drive, and therefore a greater moment arm, so that the drive has to take a heavier form.

The stability of the construction is furthermore reduced by the floating suspension of the twist-locks, while the precision with which the spreader can be placed on a container likewise decreases.

Finally, owing to the increase in the dimensions of the frame in all directions, the chance of damage thereto is increased disproportionately, since a spreader in loaded state, particularly when it is hoisting a plurality of containers simultaneously, will never hang perfectly horizontally. A slightly inclining position, particularly at the start of a hoisting movement, can result in the spreader becoming jammed, for instance in a cell of a container ship, whereby very high loads will occur which will soon result in damage.

SUMMARY OF THE INVENTION

The invention therefore has for its object to provide a container gripping device of the above described type, wherein these drawbacks do not occur. According to the invention this is achieved in such a device by at least one contact element connected to the frame, which element is biased to a position located at least partly under the frame and which is adapted to brake the movement of the frame in the vicinity of a container when the frame is placed thereon. By making use of one or more contact elements connected to the frame for the purpose of braking the frame, and not using the twist-locks for this purpose, the twist-locks can be built compactly into the frame in conventional manner. Furthermore, a stable and readily placeable spreader is thus obtained.

In order to distribute the loads over the whole frame, the gripping device preferably has a number of contact elements, each arranged in the vicinity of a corner of the frame.

A compact device is obtained when the or each contact element is arranged in or on the frame and protrudes through an opening formed in the frame. The space available in the frame can thus be utilized optimally.

The or each contact element is preferably elastically deformable. The desired movement can thus be achieved with a minimum of components, whereby the chance of malfunction is relatively small.

It is on the other hand also possible for the or each contact element to be pivotally connected to the frame. This produces a readily controllable and guidable movement of the contact elements.

The or each contact element is advantageously biased by spring means arranged between the frame and the or each contact element. In this manner the loads can be uniformly transferred to the surrounding construction during braking of the frame.

In order to absorb a part of the energy during braking of the frame, the device preferably has damping means arranged between the frame and the or each contact element. When these damping means are at least partly accommodated in an elevation formed on the frame, they can take a relatively large form, and thus produce a considerable damping without protruding and being exposed to damage.

DETAILED DESCRIPTION OF THE PREFERRED EMBODIMENTS

Figure 1:
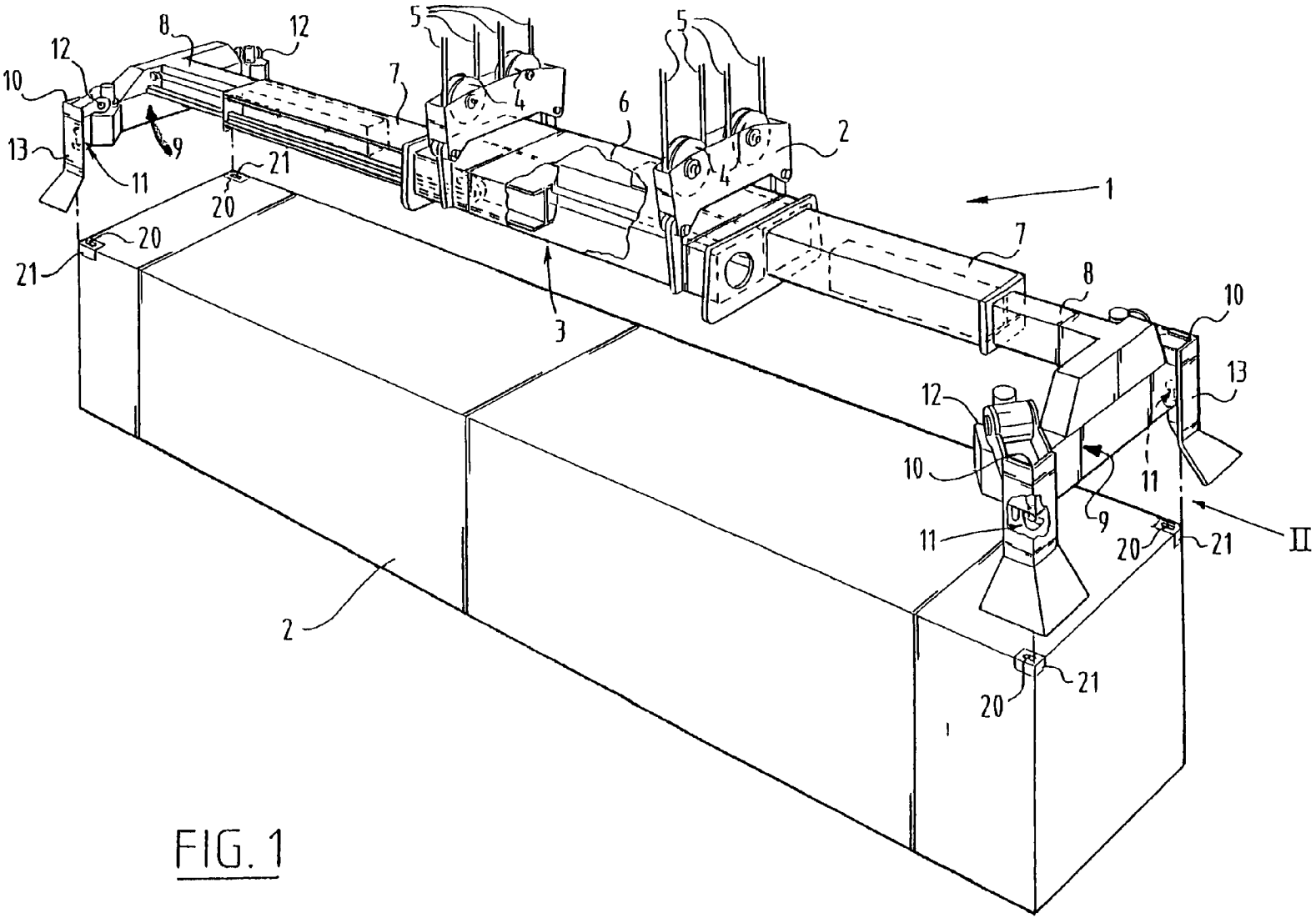
FIG. 1 is a perspective view of a container gripping device according to the invention in operation.

A gripping device 1 (FIG. 1) for picking up a container 2 from above is formed by a frame 3 which is suspended from a number of cables 5 trained over pulleys 4. In the shown embodiment the frame 3 is embodied telescopically, with a main body 6 and two sets of inner and outer telescopic arms 7,8, although it will be apparent that the invention can be applied equally well in a fixed frame.

On the end of each outer telescopic arm 8 is arranged a relatively high cross beam 9 which in each case has on its corners 10 gripping means in the form of a twist-lock 11. In addition, centring members or flippers 13 pivotable on shafts 12 are also placed on the corners.

Each twist-lock 11 is formed by a hammer-head bolt 14, the shank 18 of which is received in a guide sleeve 15. At the top the shank 18 of hammer-head bolt 14 is fastened in an operating sleeve or crank 16, which is connected in turn to an operating mechanism 22. Hammer-head bolt 14 can be rotated around an axis 17 by this operating mechanism 22, which does not form part of the present invention and will not be further described here.

Situated on the free outer end of shank 18 is a hammer head 19 which is formed and dimensioned such that it can be placed in an elongate opening 20 in a corner part or corner casting 21 of container 2, and can be hooked fixedly in this opening 20 by being rotated through 90° on axis 17.

Gripping device 1 is further provided in conventional manner with corner rollers 23 for guiding frame 3 in small spaces, as well as a sensor 24 which detects the movement of a feeler 25 and on the basis thereof drives a locking mechanism for twist-lock 11.

Figure 2:
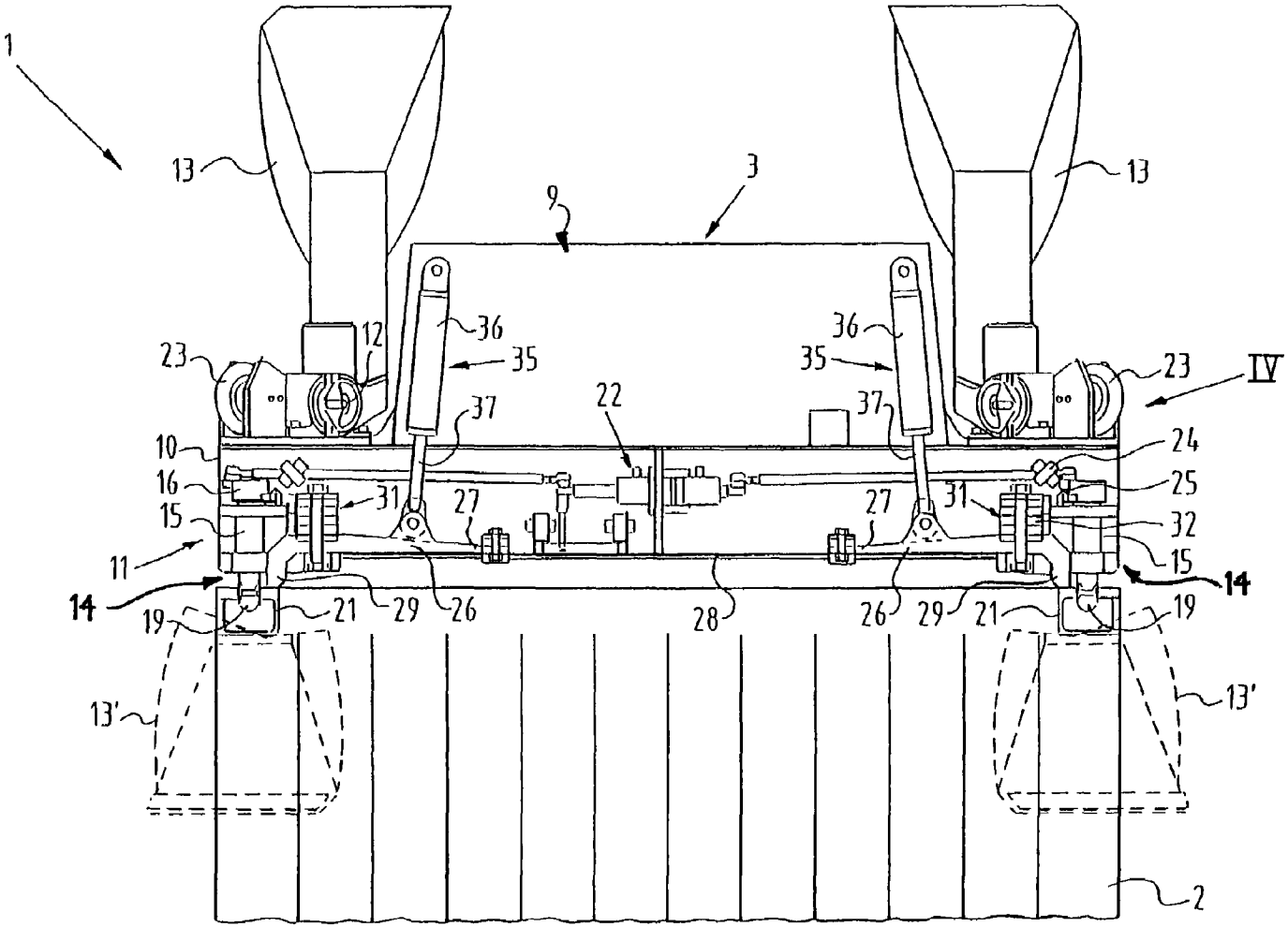
FIG. 2 is a partly cross-sectional end view according to arrow II in FIG. 1, in which the device is shown at the moment of contact with a container.
Figure 3:
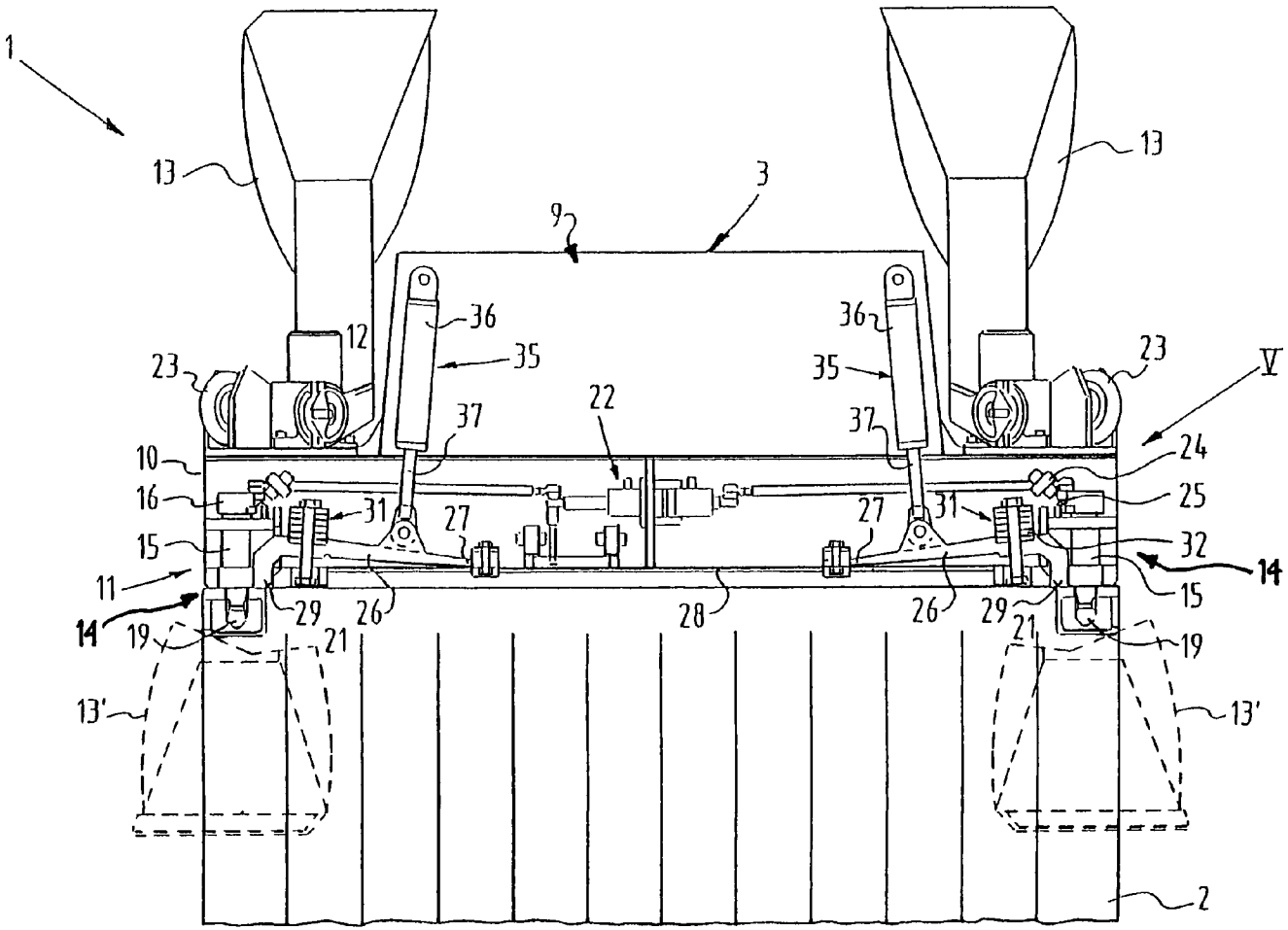
FIG. 3 is a partly cross-sectional end view corresponding with FIG. 2 of the device at the moment that the frame rests fully on the container.
Figure 4:
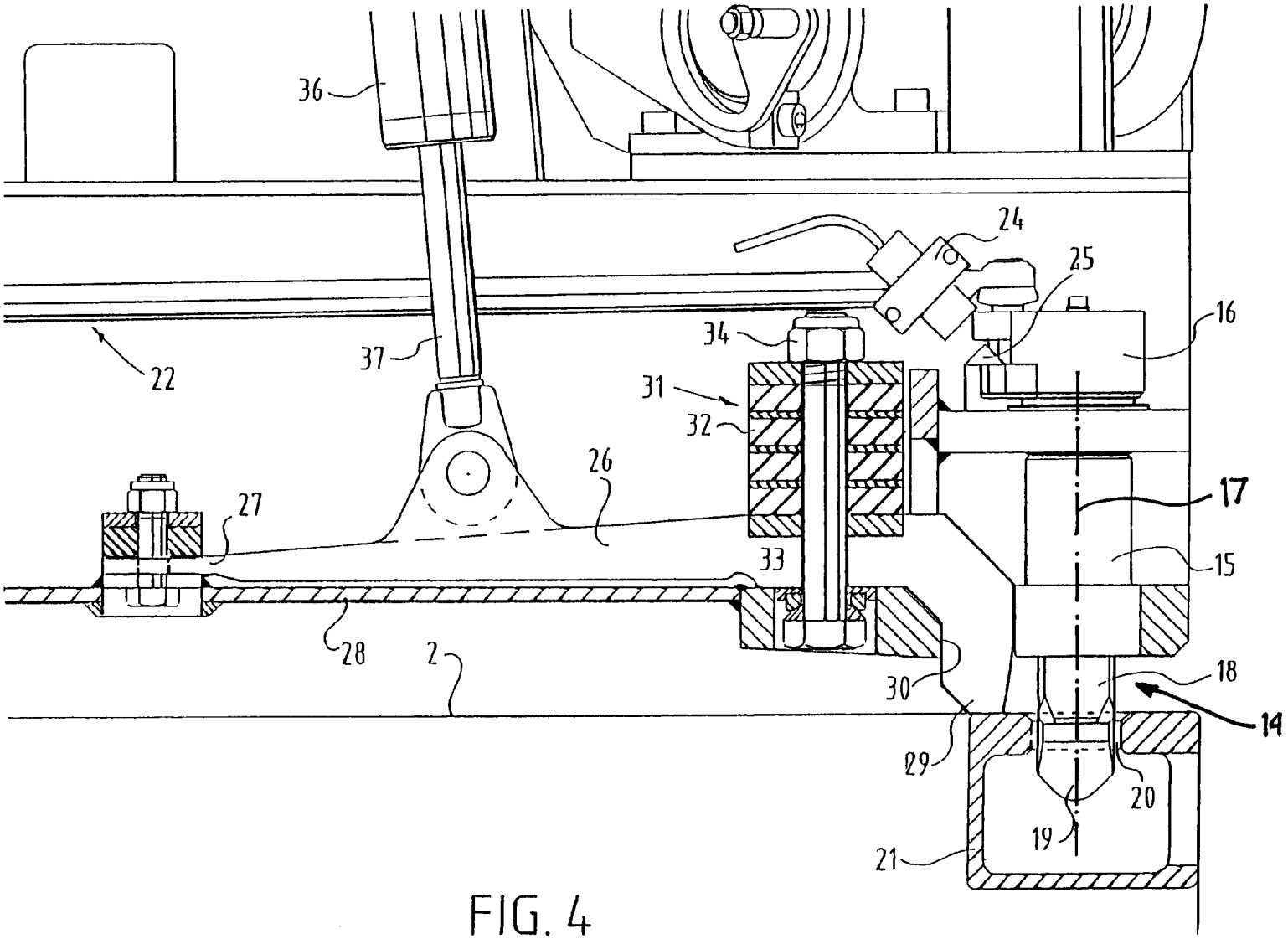
FIGS. 4 and 5 are detail views according to arrows IV and V in FIGS. 2 and 3.
Figure 5:
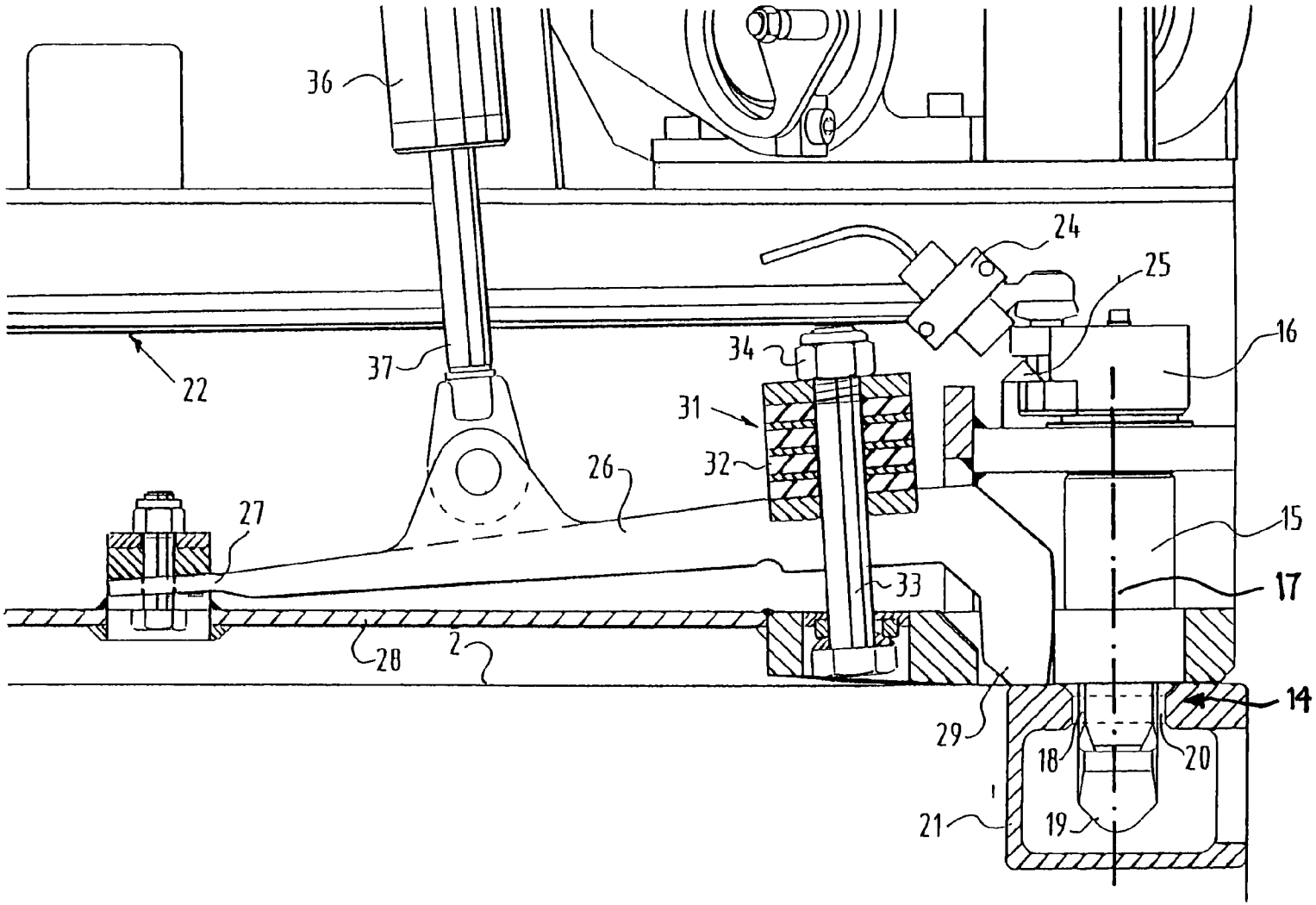

In order to limit the loads on device 1 as much as possible during lowering of frame 3 onto container 2, contact elements 26 are arranged in the vicinity of corners 10 of frame 2, which elements are biased into a position in which they protrude partly below the frame. In the shown embodiment each contact element 26 is formed by an L-shaped leg, an end part 27 of which is fixed on the base 28 of cross beam 9, while the free end part 29 protrudes through an opening 30 in this base 28. Each L-shaped contact element 26 is mounted rigidly here, but is given a narrowed form close to its end part 27, whereby this part is resiliently deformable. In the unloaded situation each contact element 26 takes up the position shown in FIG. 2, wherein end part 30 therefore protrudes below frame 3.

When frame 3 is now lowered onto a container 2 for hoisting, it is the protruding end parts 30 of contact elements 26 which first come into contact with the upper side of container 2. Contact elements 26 will herein bend upward under the influence of the weight of the lowering frame 3, whereby a part of the kinetic energy of frame 3 is absorbed and it is thus braked. The contact elements are dimensioned herein such that even when the end parts 30 completely disappear into frame 3, the occurring deformations are still in the elastic range, so that contact elements 26 will thus spring back when the load is removed.

In order to enable the absorption of an even greater part of the kinetic energy of frame 3, spring means 31 are also arranged between contact elements 26 and frame 3. These spring means 31 are formed here by compression springs 32 placed around bolts 33 which are in turn mounted in base 28 of cross beam 9, protrude through the L-shaped legs and each carry a lock nut 34 on their free outer end.

Both the spring means 31 and the contact elements 26 will in principle spring back when they are relieved of load, whereby all energy stored therein would be released. This could result in the occurrence of great forces, whereby the frame could be greatly accelerated. In order to prevent this, damping means 35 are also arranged between contact elements 26 and frame 3. These damping means 35, here in the form of hydraulic cylinders 36, the piston rods 37 of which are connected to contact elements 26, are each arranged in the shown embodiment in the high part of cross beam 9, whereby they can have a considerable volume and can therefore bring about a high degree of damping. Uncontrolled springing-back of spring means 31 and contact elements 26 is avoided due to this damping. Furthermore, the movement of the frame when landing on container 2 is hereby braked more smoothly than would be possible on the basis of the deformation of contact elements 26 and spring means 31.

Owing to contact elements 26, supplemented here with spring means 31 and damping means 35, the downward movement of frame 3 is thus braked as it makes contact with container(s) 2, whereby the occurring loads, and thereby also the noise, remain limited. Twist-locks 11 are moreover hereby pulled smoothly into corner castings 21 when hoisting begins, so that the noise is here also limited.

Although the invention is elucidated above on the basis of an embodiment, it will be apparent that it is not limited thereto. The contact elements could thus take a movable instead of a deformable form. Movements other than the shown pivoting movement can also be envisaged, for instance a vertical sliding movement. In addition, other spring and/or damping means can of course be applied, whether of hydraulic, pneumatic or mechanical type. The scope of the invention is therefore defined solely by the appended claims.

The invention claimed is:

1. A device for gripping containers from above, comprising:

a substantially horizontal frame having a plurality of corners, the frame being suspended from a plurality of substantially vertical cables;

a plurality of twist-locks, each twist-lock arranged substantially adjacent one of the corners of the frame for gripping an upper corner of the containers, each twist-lock including a substantially vertical shank; and at least one L-shaped contact element comprising a substantially horizontal first leg having opposite first and second ends and a substantially vertical second leg having opposite first and second ends, the first and second legs being rigidly connected to each other at their second ends, the first end of the substantially horizontal first leg being connected to the frame and the substantially vertical second leg extending downward from its second end that is rigidly connected to the substantially horizontal first leg, wherein the at least one L-shaped contact element is biased to a position in which its substantially vertical second leg protrudes substantially parallel to the shanks of the twist-locks and at least partially under the frame and wherein the at least one L-shaped contact element is adapted to brake a movement of the frame parallel to the cables in the vicinity of a container when the frame is placed thereon and the first end of the second leg of the at least one L-shaped contact element contacts the container, by absorbing at least a portion of kinetic energy of the frame through controlled deformation or movement of the at least one L-shaped contact element.

2. The container gripping device as claimed in claim 1, comprising a plurality of contact elements, each arranged in the vicinity of a corner of the frame.

3. The container gripping device as claimed in claim 1, wherein the frame includes an inner area and an outer area, and wherein the first leg of the at least one contact element is arranged one of in and on the frame and wherein the second leg protrudes below the frame through an opening formed in the frame.

4. The container gripping device as claimed in claim 3, wherein the first end of the first leg of the at least one contact element is rigidly mounted to the frame and wherein the at least one contact element is elastically deformable.

5. The container gripping device as claimed in claim 3, wherein the at least one contact element is pivotally connected to the frame.

6. The container gripping device as claimed in claim 3, wherein the at least one contact element is biased by spring means arranged between the frame and the contact element.

7. The container gripping device as claimed in claim 3, further comprising damping means arranged between the frame and the at least one contact element.

8. The container gripping device as claimed in claim 1, wherein the first end of the first leg of the at least one contact element is rigidly mounted to the frame and wherein the at least one contact element is elastically deformable.

9. The container gripping device as claimed in claim 8, wherein the at least one contact element is pivotally connected to the frame.

10. The container gripping device as claimed in claim 8, wherein the at least one contact element is biased by spring means arranged between the frame and the contact element.

11. The container gripping device as claimed in claim 1, wherein the at least one contact element is pivotally connected to the frame.

12. The container gripping device as claimed in claim 11, wherein the at least one contact element is biased by spring means arranged between the frame and the contact element.

13. The container gripping device as claimed in claim 1, wherein the at least one contact element is biased by spring means arranged between the frame and the contact element.

14. The container gripping device as claimed in claim 1, further comprising damping means arranged between the frame and the at least one contact element.

15. The container gripping device as claimed in claim 14, wherein the damping means are at least partly accommodated in an upper area of the frame.

16. The device as claimed in claim 1, wherein the first and second legs of the L-shaped contact element are integrally formed.

17. A device for gripping containers from above, comprising:

a substantially horizontal frame having a plurality of corners;

a plurality of twist-locks, each twist-lock arranged close to one of the corners of the frame for gripping an upper corner of the containers; and a plurality of L-shaped contact elements, each of the plurality of contact elements arranged in the vicinity of a corner of the frame;

wherein each L-shaped contact element has a substantially horizontal first leg and a substantially vertical second leg rigidly connected to the first leg and extending downward therefrom, an end part of the substantially horizontal first leg opposite the rigid connection with the substantially vertical second leg being connected to the frame;

wherein each L-shaped contact element is biased to a position in which the substantially vertical seconds leg thereof protrudes at least partially under the frame and is adapted to brake a vertical movement of the frame in the vicinity of a container when the frame is placed thereon and the substantially vertical second legs of the L-shaped contact elements contact the container, by absorbing at least a portion of kinetic energy of the frame through controlled deformation or movement of the L-shaped contact elements.

18. The container gripping device as claimed in claim 17, wherein the frame includes an inner area and an outer area, and wherein the first leg of each of the plurality of contact elements is arranged one of in or on the frame and wherein the second leg protrudes below the frame through an opening formed in the frame.

19. The container gripping device as claimed in claim 17, wherein each of the plurality of contact elements is elastically deformable and has its first end part rigidly mounted to the frame.

20. The container gripping device as claimed in claim 17, wherein each of the plurality of contact elements is pivotally connected to the frame.

21. The container gripping device as claimed in claim 17, wherein each of the plurality of contact elements is biased by spring means arranged between the frame and the respective contact element.

22. The container gripping device as claimed in claim 17, further comprising damping means arranged between the frame and each of the plurality of contact elements.

23. The device as claimed in claim 17, wherein the first and second legs of the L-shaped contact element are integrally formed.

24. A device for gripping containers from above, comprising:

a substantially horizontal frame having a plurality of corners;

means arranged close to each of the corners of the frame for gripping an upper corner of the containers; and at least one L-shaped contact element comprising a substantially horizontal first leg having one end connected to the frame separately from the gripping means and a substantially vertical second leg rigidly connected to the first leg opposite its connection to the frame and extending downwardly from said first leg, wherein the at least one L-shaped contact element is biased to a position in which its substantially vertical second leg protrudes at least partially under the frame and wherein the at least one L-shaped contact element is adapted to brake a vertical movement of the frame in the vicinity of a container when the frame is placed thereon and the second leg of the at least one L-shaped contact element contacts the container, by absorbing at least a portion of kinetic energy of the frame through controlled deformation or movement of the at least one L-shaped contact element.

25. The device as claimed in claim 24, wherein the first and second legs of the L-shaped contact element are integrally formed.

26. A device for gripping containers from above, comprising:

a substantially horizontal frame having a plurality of corners;

a plurality of twist-locks, each twist-lock fixedly mounted on the frame substantially adjacent one of the corners of said frame;

at least one L-shaped contact element comprising a substantially horizontal first leg having an end connected to the frame and a substantially vertical second leg rigidly connected to the first leg at an end opposite the connection to the frame, the second leg extending downward from the first leg, the at least one L-shaped contact element being biased to a position in which its second leg protrudes at least partially under the frame;

wherein the at least one L-shaped contact element is deformable or moveable independently from the twist-locks, so as to brake a vertical movement of the frame when the frame is placed on a container and the second leg of the at least one L-shaped contact element contacts the container, by absorbing at least a portion of kinetic energy of the frame through controlled deformation or movement of the at least one L-shaped contact element, while the twist-locks remain stationary with respect to the frame.

27. The device as claimed in claim 26, wherein the first and second legs of the L-shaped contact element are integrally formed.

* * * * *

UNITED STATES PATENT AND TRADEMARK OFFICE

CERTIFICATE OF CORRECTION

PATENT NO. : 7,665,784 B2
APPLICATION NO. : 10/296277
DATED : February 23, 2010
INVENTOR(S) : Cornelis Stinis It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 380 days.

Signed and Sealed this

Seventh Day of December, 2010

David J. Kappos

David J. Kappos
*Director of the United States Patent and Trademark Office*